US005347133A

United States Patent [19]

Toki et al.

[11] Patent Number: 5,347,133

[45] Date of Patent: Sep. 13, 1994

[54] POWDER AGITATOR

[75] Inventors: Hitoshi Toki; Yoshihisa Yonezawa; Shigeo Itoh, all of Mobara, Japan

[73] Assignee: Futaba Denshi Kogyo K.K., Mobara, Japan

[21] Appl. No.: 82,460

[22] Filed: Jun. 25, 1993

[30] Foreign Application Priority Data

Jun. 25, 1992 [JP] Japan ..... 4-191682

[51] Int. Cl.[5] ..... H01J 5/00

[52] U.S. Cl. ..... 250/492.3; 366/111

[58] Field of Search ..... 250/492.3, 492.1, 398, 250/251, 428, 432 R; 366/110, 111, 114, 208, 209, 210, 216

[56] References Cited

U.S. PATENT DOCUMENTS 3,790,787 2/1974 Geller ..... 250/251

3,932,760 1/1976 Inoue ..... 250/251

*Primary Examiner*—Paul M. Dzierzynski

*Assistant Examiner*—Kiet T. Nguyen

*Attorney, Agent, or Firm*—Oblon, Spivak, McClelland, Maier & Neustadt

[57] ABSTRACT

A powder agitator used for an ion implantation device or an ionized beam deposition device capable of exhibiting satisfactory powder agitating characteristics and minimizing positive charging on powders. The powder agitator includes a base, a vessel for receiving powders therein, a plurality of supports for supporting the vessel on the base, and a pair of piezoelectric elements arranged on the supports and functioning as a vibration generating section. Application of a voltage to the piezoelectric elements causes the vessel to be oscillated in a direction of rotation of the vessel and a speed of oscillation of the vessel to be varied depending on a direction of oscillation of the vessel, resulting in agitating the powders in the vessel.

4 Claims, 5 Drawing Sheets

POWDER AGITATOR

BACKGROUND OF THE INVENTION

This invention relates to a powder agitator used for an ionized beam deposition device or an ion implantation device, and more particularly to a powder agitator exhibiting increased powder agitating characteristics.

A conventional ion implantation device is generally constructed in such a manner as shown in FIG. 4. More particularly, it includes a vacuum casing 1, which is kept at a high vacuum due to evacuation by means of a vacuum pump (not shown) connected thereto. The vacuum casing 1 is also connected to an ionization chamber (not shown).

The vacuum casing 1 is provided therein with a vessel 2 and a plurality of propeller blades 3. The vessel 2 is formed of a metal material into a substantially cylindrical shape. The vacuum casing 1 thus constructed cooperates with a drive section 4 arranged outside the casing 1 to provide a powder agitator. The vessel 2 is grounded to discharge positive charges on powders A in the vessel 2. The drive section 4 causes the vessel 2 and propeller blades 3 to be rotated in direction opposite to each other, resulting in the powders A in the vessel 2 being agitated.

The vacuum casing 1 is also provided therein with a neutralizing filament 5 for neutralizing positive charges of ions, so that electrons may be showered in the vacuum casing 1. Further, the vacuum casing 1 is a Faraday cup 6 for measuring the amount of ions implanted, a beam guide 7 for guiding ionized beams, and the like. The vacuum casing 1 is also provided at a portion thereof connected to an ion source with a deflection coil 8 and a shutter 9.

In the conventional ion implantation device constructed as described above, a material to be implanted is ionized in an ionization chamber (not shown) and impinged on the powders A in the vessel 2 while being accelerated at a voltage of 10 to 400kv, resulting in the ions being implanted in the powders. The conventional device causes the implantation to be limited to a depth as small as about 0.1 micron.

Also, the ion implantation requires to eliminate positive charges of the ions by neutralizing or discharging. However, a failure in the neutralization or discharge causes the positive charges to be loaded on the powders A, resulting in a material to be implanted being scattered or dispersed toward a periphery of the vessel.

The conventional powder agitator, as described above, is so constructed that the propeller blades 3 arranged in the vessel 2 agitate the powders A, therefore, it fails in satisfactory agitation of the powders A unless the amount of powders A to be treated is large. However, an increase in amount of the powders A causes a period of time required for ion implantation to be significantly increased.

In addition, the conventional powder agitator includes a rotation section comprising the vessel 2 and propeller blades 3, so that dusts discharged from the drive section adversely affect the rotation section.

Further, the vessel 2 is charged with a large amount of powders A, resulting in rendering uniform distribution of electrons for neutralization throughout the powders A difficult. In particular, when the powders A to be treated have high resistance, it is impossible to neutralize positive charges of ions and discharge the positive charges from the vessel 2, so that the powders A are kept positively charged, resulting in most of a material to be implanted being scattered toward a periphery of the vessel 2.

Moreover, in the conventional powder agitator, it is required to locate the vessel 2 and propeller blades 3 at a relatively high position with high accuracy. Otherwise, there often occurs a trouble that particles of the powders A pass through gaps between the propeller blades 3 and the vessel 2 or are caught therebetween.

The above-described disadvantages of the conventional powder agitator are likewise encountered with an ionized beam deposition device.

SUMMARY OF THE INVENTION

The present invention has been made in view of the foregoing disadvantages of the prior art.

Accordingly, it is an object of the present invention to provide a powder agitator for an ion implantation device or an ionized beam deposition device which is capable of restraining powders from being positively charged and exhibiting satisfactory powder agitating characteristics.

It is another object of the present invention to provide a powder agitator which is capable of effectively eliminating positive charges due to discharge or neutralization.

It is a further object of the present invention to provide a powder agitator which is capable of allowing ion implantation and ionized beam deposition to be uniformly accomplished.

In accordance with the present invention, a powder agitator is provided which is used for an ion implantation device or an ionized beam deposition device. The powder agitator includes a vessel for receiving powders therein and a drive section for vertically moving the vessel while rotating the vessel and keeping the vessel horizontal. The drive section carries out rotation of the vessel while alternating a direction of rotation of the vessel and varying a rotational speed of the vessel depending on the direction of rotation of the vessel.

Also, in accordance with the present invention, a powder agitator is provided which is used for an ion implantation device for implanting powders with an additive at least partially ionized in a vacuum or an ionized beam deposition device for coating powders with an additive at least partially ionized in a vacuum. The powder agitator includes a base arranged in the device, a vessel for receiving the powders therein, a plurality of elastically deformable supports for supporting the vessel on the base, and a vibration generating section arranged on one of the base and supports for oscillating the supports to vertically move the vessel while alternating a direction of rotation of the vessel and varying a rotational speed of the vessel depending on the direction of rotation of the vessel as well as keeping the vessel horizontal.

In a preferred embodiment of the present invention, the vessel is provided on a bottom with projections.

In the powder agitator of the present invention constructed as described above, the vessel having the powders received therein is laterally alternately rotated at a rotational speed varied depending on the direction of rotation and vertically moved while being kept horizontal, so that force due to a change in rotational speed of the vessel permits the powders to be transferred on a surface of the vessel while rolling on the surface.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein:

FIG. 2(*b*) is a sectional side elevation view taken along line B—B of FIG. 2(*a*);

FIG. 5(*b*) is a sectional side elevation view of the vessel shown in FIG. 5(*a*);

FIG. 6(*b*) is a sectional side elevation view of the vessel shown in FIG. 6(*a*).

DETAILED DESCRIPTION OF THE PREFERRED EMBODIMENT

Now, a powder agitator according to the present invention will be described hereinafter with reference to the accompanying drawings.

Figure 1:
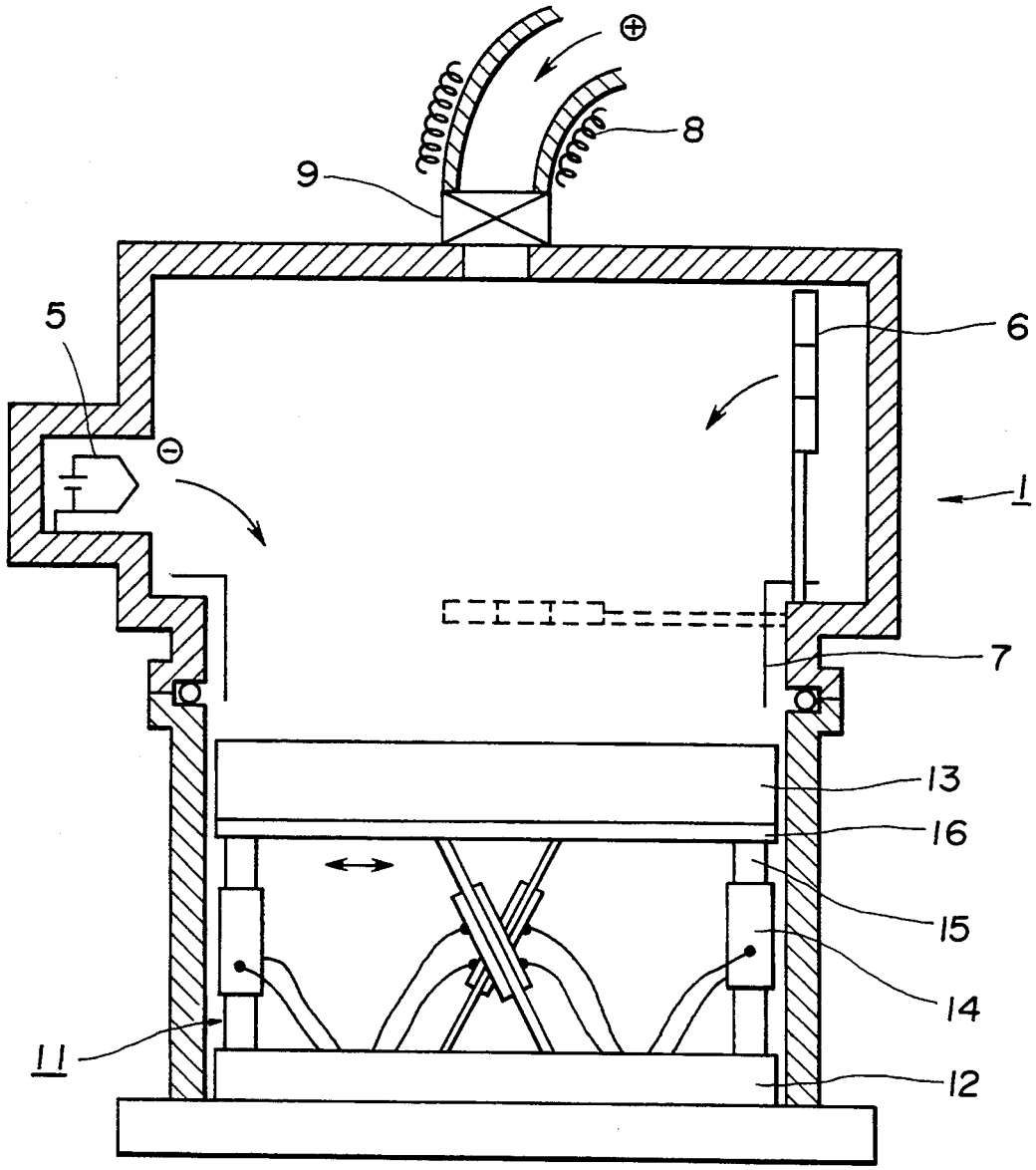
FIG. 1 is a vertical sectional view showing an embodiment of a powder agitator according to the present invention, which is mounted in an ion implantation device.
Figure 4:
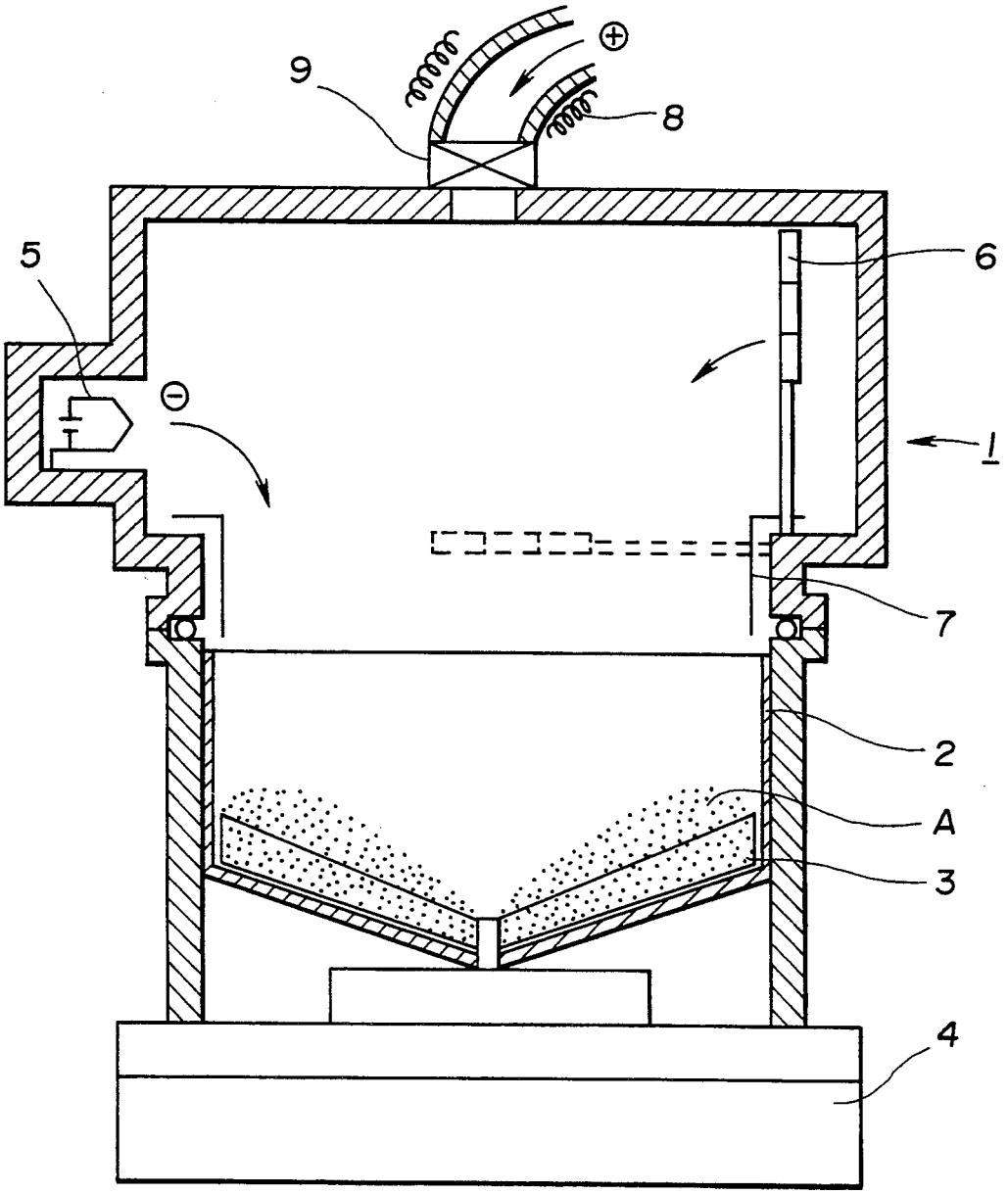
FIG.4 (PRIOR ART)
FIG. 4 is a vertical sectional view showing a conventional powder agitator.

Referring first to FIG. 1, an embodiment of a powder agitator according to the present invention is illustrated, which is mounted in an ion implantation device. Like reference numerals which are commonly used in FIG. 1 and FIG. 4 showing the above-described prior art designate corresponding parts.

A powder agitator of the illustrated embodiment generally designated by reference numeral 11 in FIG. 1 generally includes a base 12 arranged on a bottom of a vacuum casing 1, a cylindrical vessel 13 in which powders are received, a pair of piezoelectric elements 14 functioning as a vibration generating section, a plurality of elastically deformable supports 15 and an upper plate 16.

More particularly, the supports 15 are arranged at four positions defined on diagonal lines while being kept oblique. The supports 15 each are mounted at one end thereof on a top or upper surface of the base 12 and at the other end thereof on a lower or bottom surface of the upper plate 16. The vessel 13 is integrally mounted on the upper plate 16 by means of screws or the like. Thus, the vessel 13 is supported on the base 12 through the upper plate 16 and by means of the supports 15.

The piezoelectric elements 14 each are formed of a ceramic material mainly consisting of barium titanate, lead titanate or lead zirconate. To the piezoelectric elements 14 arranged opposite to each other with each of the supports 15 being interposed therebetween are alternately applied voltages different in polarity, resulting in the piezoelectric elements 14 selectively expanded and contracted. Such contraction and expansion of the piezoelectric elements 14 causes distal ends of each of the supports 14 to be oscillated. Therefore, adjustment or alignment of directions in which the supports 15 are oscillated permits the vessel 13 to be vertically moved while being laterally alternately rotated as indicated at arrows in FIG. 1 and kept horizontal. Such movement of the vessel 13 will be referred to as "rotating and oscillating movement" hereinafter. Also, a period of time for which a voltage is applied to the piezoelectric elements 14 may be varied depending on a polarity of the voltage applied. Such construction permits a velocity or speed of the rotating and oscillating movement of the vessel 13 to be varied depending on a direction of rotation of the vessel 13.

For example, when a voltage being applied to the piezoelectric elements 14 so that the supports 15 are deflected in a direction which causes the vessel 13 to be rotated in a clockwise direction is cut, the vessel 13 is rapidly returned to the original state due to restoring force of the supports 15 elastically deformed, so that a speed of rotating and oscillating movement of the vessel 13 may be varied depending on the direction of rotation of the vessel. Such a variation in speed of rotating and oscillating movement of the vessel 13 depending on the direction of oscillation of the vessel permits the powders to be moved in a predetermined direction while elastically rolling in the vessel 13.

Now, construction of the vessel 13 will be described with reference to FIGS. 2(*a*) and 2(*b*), wherein FIG. 2(*a*) is a plan view of the vessel 13 and FIG. 2(*b*) is a sectional view taken along line B—B of FIG. 2(*a*). The vessel 13 is formed of a metal material such as stainless steel or the like into a cylindrical shape and provided on a bottom thereof with fins 13*a* so as to cross each other. The fins 13*a* each are arranged in such a manner that a slanting surface thereof faces in a direction of movement of the powder. Also, the vessel 13 is formed at a central portion of a bottom thereof with a mounting hole 13*b* through which the vessel 13 is mounted on the upper plate 16. The vessel 13 thus constructed is grounded , resulting in being kept at a constant voltage.

Figure 2:
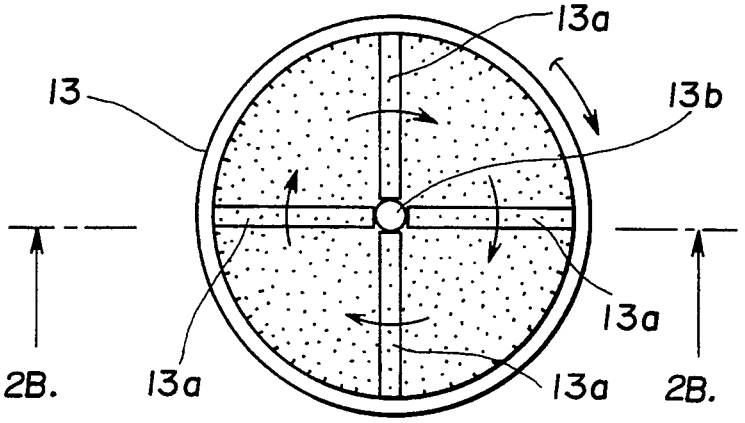
FIG. 2(*a*) is a plan view showing an example of a vessel incorporated in a powder agitator according to the present invention.
Figure 2:
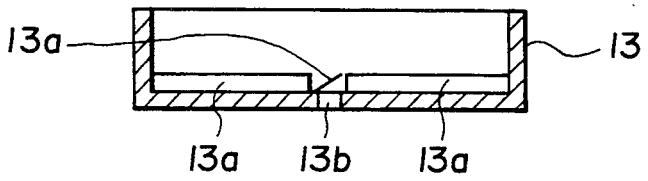

In the powder agitator of the illustrated embodiment constructed as described above, a cooperative action of the piezoelectric elements 14 and supports 15 permits the vessel 13 to carry out rotating and oscillating movement and a direction of oscillation of the vessel to be varied depending on a direction of the rotating and oscillating movement, resulting in the powders in the vessel 13 being moved in a predetermined direction while rolling in the vessel 13, as indicated at arrows in FIG. 2(*a*).

Thus, application of the powder agitator of the illustrated embodiment to an ion implantation device or an ionized beam deposition device permits agitation of powders to be positively carried out even when the amount of powders is reduced, resulting in ion implantation or ionized beam deposition being uniformly accomplished. Also, the vessel 13 is kept grounded; so that even when powders to be treated are electrically conductive, positive charges may be positively discharged. Further, the powder agitator of the illustrated embodiment can reduce the amount of powders to be treated and exhibit satisfactory agitating characteristics; so that even when powders to be treated have high resistance, uniform distribution of electrons for neutralization throughout the powders may be accomplished, leading to effective neutralization of positive charges.

Powders which are to be subject to ion implantation are not positively charged, therefore, the powder agitator of the illustrated embodiment prevents scattering of the powders, to thereby ensure ion implantation or ionized beam deposition with high efficiency. Also, the powder agitator of the illustrated embodiment is so constructed that the drive section is free of any rotation member, resulting in eliminating such disadvantages of the prior art as described above which are caused by lubricant used for a drive section and dust or any foreign matter entering through the drive section. Thus, an ionized beam deposition device or an ion implantation device to which the powder agitator of the illustrated embodiment is applied may be significantly simplified in structure.

Now, a comparative experiment which the inventors made on a powder agitator of the present invention and a conventional propeller agitator will be described with reference to FIGS. 5(*a*) and 5(*b*) and FIGS. 6(*a*) and 6(*b*), wherein FIGS. 5(*a*) and 5(*b*) show a vessel C of a powder agitator of the present invention and FIG. 6(*a*) and 6(*b*) show a vessel D of a conventional propeller agitator.

$Al_2O_3$ in an amount of 102 g/mol ($6.02\times10^{23}$/mol) was used as powders to be treated or agitated and Zn was used as an element to be implanted. The vessels C and D each were formed into 100$\phi$. Conditions for the implantation were as follows:

Acceleration Voltage: 100keV

Acceleration Current: 100$\mu$A

Irradiation Area: 60 to 80$\phi$

When a beam irradiation diameter is set to be equal to a diameter of the vessel, there is much possibility that the implantation is carried out with respect to a side wall of the vessel, resulting in failing to accurately determine the amount of a material to be implanted; therefore, the beam diameter was somewhat smaller than the diameter of the vessel and biased.

The amount of implantation was as follows:

a. $5\times10^{-5}$ atm/mol b. $5\times10^{-4}$ atm/mol

In the case of powders 1/mol:

$$6.02\times10^{23}\times1/10=6.02\times10^{22}=6.02\times10^{22}/\text{mol}$$

At an ion current of 100$\mu$A, the amount of irradiation per one second was as follows:

$$1\times10^{4}\,(\text{A})/1.6\times10^{-14=6.3\times1014}/\text{sec}$$

Time required for doping the amount of $5\times10^{-5}$ atm/mol was as follows:

$$6.02\times10^{22\times5\times10-6/6.3\times1014=1.3}\ \text{hours}$$

In connection with the implantation in the vessel C, Zn in an amount of $5\times10^{-4}$ atm/mol was implanted in $Al_2O_3$ in an amount of 2 to 20g without scattering of the powders due to charge-up (for 2.5 to 25 hours).

In the vessel D, charging of $Al_2O_3$ in an amount: of 2 to 5g caused both a bottom of the vessel and propeller blades to be partially exposed, so that it was impossible to accurately determine the amount of implantation. Charging of $Al_2O_3$ in an mount of 6 to 15 prevented exposing of the vessel. However, charging of $Al_2O_3$ in an amount of 6g caused 20 to 50% of the powders to be scattered in 2 hours, whereas charging of $Al_2O_3$ in an amount of 15g caused it to be scattered in 1.5 hours Also, charging of the powders in an amount of 15g or more results in 50% of the powders or more being scattering in 1 hour, leading to stopping of the powder agitator.

Figure 5:
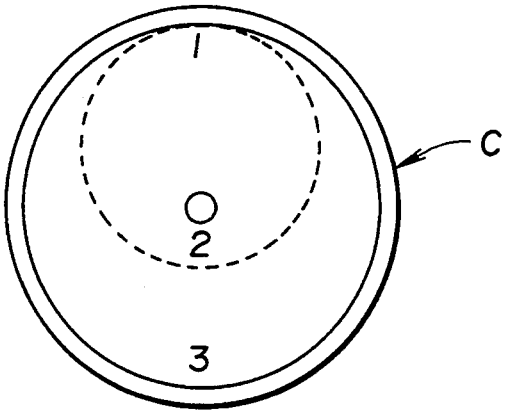
FIG. 5(*a*) is a plan view showing a further example of a vessel incorporated in a powder agitator according to the present invention.
Figure 5B:
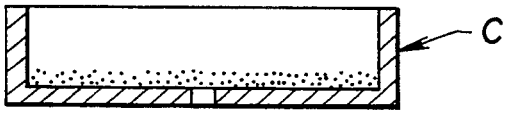
Figure 6A:
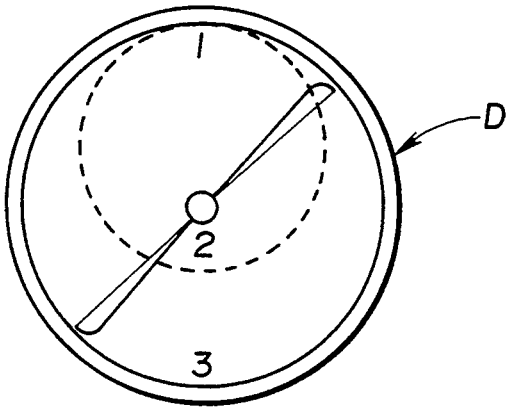
FIG.6(a) (PRIOR ART)
FIG. 6(*a*) is a plan view showing a vessel of a conventional propeller agitator.
Figure 6B:
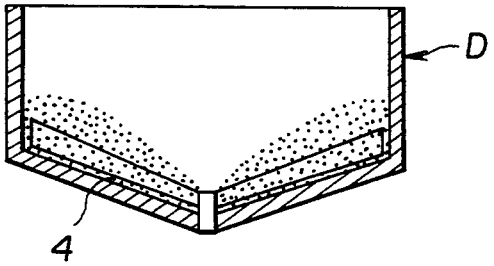
FIG.6(b) (PRIOR ART)

In an experiment for determining uniformity of the implantation, sampling in each of the vessels C and D was carried out at locations shown in FIGS. 5(*a*) to 6(*b*). A sampling location 4 in the vessel D was a position at which a sample between propeller blades and a bottom of the vessel is contacted with the bottom. Each sampling was carried out in an amount of 1g.

The amount of powders used was 10g. Evaluation was made by dissolving the powders in acid and determining Zn by atomic-absorption spectroscopy.

| | | | |
|---|---|---|---|
| a. | $5\times10^{-5}$ atm/mol (1.3 hours) | | |
| | C | 1 | $4.9\times10^{-5}$ |
| | | 2 | $4.5\times10^{-5}$ |
| | | 3 | $5.4\times10^{-5}$ |
| | D | 1 | $5.4\times10^{-5}$ |
| | | 2 | $6.6\times10^{-5}$ |
| | | 3 | $4.0\times10^{-5}$ |
| | | 4 | $1.0\times10^{-5}$ |
| b. | $5\times10^{-4}$ atm/mol (13 hours) | | |
| | C | 1 | $5.0\times10^{-4}$ |
| | | 2 | $5.1\times10^{-4}$ |
| | | 3 | $4.8\times10^{-4}$ |
| | D | 1 | Exposing of Vessel Surface due to Scattering |
| | | 2 | $10\times10^{-4}$ |
| | | 3 | Exposing of Vessel Surface due to Scattering |
| | | 4 | $0.5\times10^{-4}$ |

Figure 3:
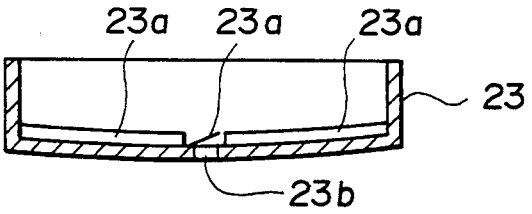
FIG. 3 is a sectional side elevation view showing another example of a vessel incorporated in a powder agitator according to the present invention.

FIG. 3 shows another example of the vessel in the powder agitator of the present invention. A vessel 23 is formed into a substantially cylindrical shape as in the vessel described above.

The vessel 23 is formed on a bottom thereof with a plurality of fins 23*a* and a mounting hole 23*b*. Also, the bottom of the vessel 23 is formed into a curved shape. Such configuration of the vessel 23 prevents powders from being biased toward a peripheral surface of the vessel due to centrifugal force produced during rotating and oscillating movement of the vessel.

In the powder agitator of the illustrated embodiment, a piezoelectric element is used for the drive section. Alternatively, any other suitable means may be used for the drive section so long as it can vary a speed or velocity of oscillation of the vessel depending on a direction of rotation of the vessel. For example, magnetic attracting force of an electromagnet or its magnetic repulsion force may be utilized for this purpose. Also, a combination of such force with restoring force of a leaf spring or the like may be effectively utilized.

As can be seen from the foregoing, application of the powder agitator of the present invention to an ion implantation device or an ionized beam deposition device permits ion implantation or ionized beam deposition to be uniformly carried out because it exhibits increased agitating characteristics even when the amount of powders to be treated is reduced.

Also, satisfactory agitating characteristics of the present invention permits positive charges to be positively eliminated by discharge or neutralization irrespective of a magnitude of resistance of powders to be treated, to thereby ensure efficient ion implantation or ionized beam deposition.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A powder agitator in combination with an ion implantation device or an ionized beam deposition device, comprising:

a vessel for receiving powders therein; and a drive section coupled to said vessel for vertically moving said vessel while rotating said vessel and keeping said vessel horizontal;

said drive section carrying out rotation of said vessel while alternating a direction of rotation of said vessel and varying a rotational speed of said vessel depending on the direction of rotation of said vessel.

2. A powder agitator as defined in claim 1, wherein said vessel is provided on a bottom thereof with a a plurality of fins.

3. A powder agitator in combination with an ion implantation device for implanting powders with an additive at least partially ionized in a vacuum or an ionized beam deposition device for coating powders with an additive at least partially ionized in a vacuum, comprising:

a base arranged in one of said devices;

a vessel for receiving said powders therein;

a plurality of elastically deformable supports for supporting said vessel on said base; and a vibration generating section arranged on said supports for oscillating said supports to vertically move while rotating said vessel, said vibration generating alternating a direction of rotation of said vessel and varying a rotational speed of said vessel depending on the direction of rotation of said vessel as well as keeping said vessel horizontal.

4. A powder agitator as defined in claim 3, wherein said vessel is provided on a bottom thereof with a plurality of fins.

* * * * *